US006402436B1

(12) United States Patent
Murphy

(10) Patent No.: US 6,402,436 B1
(45) Date of Patent: Jun. 11, 2002

(54) METHOD AND DEVICE FOR CONVEYING PLANAR RIBBON OF CRIMPED FIBER USING AIR JETS

(75) Inventor: David Herbert Murphy, Kingsport, TN (US)

(73) Assignee: Eastman Chemical Company, Kingsport, TN (US)

( * ) Notice: Subject to any disclaimer, the term of this patent is extended or adjusted under 35 U.S.C. 154(b) by 0 days.

(21) Appl. No.: 09/559,631

(22) Filed: Apr. 28, 2000

(51) Int. Cl.[7] ..... B65G 53/16
(52) U.S. Cl. ..... 406/86; 406/197
(58) Field of Search ..... 414/676; 226/7, 226/97.1, 86, 88, 191; 406/197

(56) References Cited

U.S. PATENT DOCUMENTS

| | | | | |
|---|---|---|---|---|
| 3,181,916 A | | 5/1965 | Epstein | |
| 3,386,772 A | * | 6/1968 | Platter et al. | 302/2 |
| 3,610,696 A | * | 10/1971 | Fulton | 302/31 |
| 3,705,676 A | | 12/1972 | Overly et al. | |
| 3,759,579 A | * | 9/1973 | Johnston | 302/31 |
| 4,046,064 A | * | 9/1977 | Wahle | 93/1 |
| 4,131,320 A | * | 12/1978 | Volat et al. | 302/2 R |
| 4,229,861 A | | 10/1980 | Campo et al. | |
| 5,043,735 A | | 8/1991 | Mawhinney et al. | |
| 5,203,485 A | | 4/1993 | Cahill et al. | |
| 5,245,348 A | | 9/1993 | Nishikawa et al. | |
| 5,537,122 A | | 7/1996 | Eguchi | |
| 5,788,425 A | * | 8/1998 | Skow et al. | 406/88 |

FOREIGN PATENT DOCUMENTS

DE 2 040 018 2/1972

OTHER PUBLICATIONS

Mitsumoto H. Et Al: "A Mobile Satellite News Gathering System Using A Flat Antenna" IEEE Transactions on Broadcasting, US, IEEE Inc. York vol. 42, No. 3, Sep. 1996, pp. 272–276.

* cited by examiner

*Primary Examiner*—Christopher P. Ellis
*Assistant Examiner*—Joe Dillon, Jr.
(74) *Attorney, Agent, or Firm*—Cheryl J. Tubach; Harry J. Gwinnell

(57) ABSTRACT

A method and device for conveying a ribbon of crimped material includes an air mover, a plenum connected to the air mover to receive air from the air mover, a series of directional slits and side walls. The directional slits air in fluid communication with the plenum so that air from the plenum exits through the directional slits in a predetermined direction. The directional slits are arranged in a generally planar configuration to form a conveyance track. The sides walls are provided on either side of the conveyance track to extend above the conveyance track. The crimped material may be a planar band of crimped fiber, such as a planar band of crimped acetate fiber. The crimps may extend in an up-and-down direction or in a back-and-forth direction. The plenum may be formed of a pair of elongated support pieces with cutout portions in the elongated support pieces. In this case, the directional slits are formed by air knives fitting into the cutout portions of the elongated support pieces, and the elongated support pieces define the side walls. With the cutout portions, the position of the air knives within the cutout portions can be adjusted to vary the spacing between the air knives. Alternatively, the plenum may be formed from a tubular material having a hollow interior. In this case, the directional slits are cuts formed partially through the tubular material such that the cuts penetrate into the hollow interior of the tubular material.

13 Claims, 4 Drawing Sheets

METHOD AND DEVICE FOR CONVEYING PLANAR RIBBON OF CRIMPED FIBER USING AIR JETS

BACKGROUND OF THE INVENTION

1. Field of the Invention

The present invention relates in general to the production of bands of crimped fibers. More specifically, the present invention relates to a method and device for conveying crimped fiber during the production process, using air jets.

2. Description of the Related Art

In the process of producing fiber products, such as products produced by spinning, a planar ribbon of crimped fiber (also referred to as a "tow band") may be produced as an intermediate. For example, a large number of polymer strands may be spun, gathered together in a band and then crimped. After crimping, the tow band is spread back and forth on a slow moving drying conveyor. At the end of the conveyor, the dried tow band is taken off and transported to a baling machine, where the tow band is deposited to form a bale for shipment. For example, acetate tow and polyester tow can be produced in this manner.

Conventionally, the delicate crimped fiber web is dragged over a large number of stationary guides or rollers from the end of the dryer to the inlet of the baling machine. To move the fiber, it must be pulled from the dryer to the baling machine. There is friction between the stationary guides and rollers and the tow band during transportation. The pulling action associated with moving the weight of the tow, and the friction extend the fiber and remove the crimp. The crimp extension is irreversible. That is, the crimp does not return to the fiber after the external forces are removed. The fiber is taken off of the dryer at a slower speed than it is fed to the baler. For example, if the tow is coming off of the dryer at 100 meters per minute and the tow is extended 25% during transportation, then the tow must be pulled into the baling machine at a rate of 125 meters per minute.

The distance the fiber must travel from the dryer to the baling machine varies depending on the relative locations of these two pieces of machinery. Generally speaking, the further the fiber must be transported, the more the crimp in the fiber will be extended. The inlet to the baling machine may be at the same elevation level as the outlet of the dryer. Alternatively, the inlet of the baling machine may be above or below the outlet of the dryer. If the fiber is transported (pulled) uphill, more crimp is removed, and if the fiber is transported (pulled) downhill, less crimp is removed. If there are distance or elevation differences within a single plant, then the quality of the fiber tow produced by that plant will be inconsistent.

SUMMARY OF THE INVENTION

To eliminate the problems described above, a belt conveyor or a vibratory shaker conveyor might be considered as fiber transport devices. However, these devices contain a large number of moving parts, are very expensive, very large or unreliable for fiber web transport.

Accordingly, it is an object of the present invention to transport a planar ribbon of crimped fiber while minimizing the friction between the transport device and the fiber.

It is further object of the present invention to transport a planar ribbon of crimped fiber from an origin to a destination while minimizing the pulling force on the fiber at the destination.

It is yet another object of the present invention to transport a planar ribbon of crimped fiber without extending the fiber and removing the crimp.

It is a still further object of the present invention to transport a planar ribbon of crimped fiber in a manner that can maintain consistency in the amount of crimp in the fiber produced throughout a plant, even if the distances and elevations traveled throughout the plant are inconsistent.

The present invention addresses the above objects by providing a method and device for conveying crimped material, which can be used with any type of crimped material having a planar configuration and a ribbon-like form. For example, the present invention can be used with paper, ribbon, synthetic fiber, tow and natural fiber tow.

The present invention provides a method and device for conveying a ribbon of crimped material including an air mover, a plenum connected to the air mover to receive air from the air mover, a series of directional slits and side walls. The directional slits are in fluid communication with the plenum so that air from the plenum exits through the directional slits in a predetermined direction. The directional slits are arranged in a generally planar configuration to form a conveyance track. The side walls are provided on either side of the conveyance track to extend above the conveyance track.

The crimped material may be a planar band of crimped fiber, such as a planar band of crimped acetate fiber. The crimps may extend in an up-and-down direction, normal to the plane of the crimped fiber or in-and-out, parallel to the plane of the crimped fiber.

The plenum may be formed of a pair of elongated support pieces with cutout portions in the elongated support pieces. In this case, the directional slits are formed by air knives fitting into the cutout portions of the elongated support pieces, and the elongated support pieces define the side walls. With the cutout portions, the position of the air knives within the cutout portions can be adjusted to vary the spacing between the air knives. Alternatively, the plenum may be formed from a tubular material having a hollow interior. In this case, the directional slits are cuts formed partially through the tubular material such that the cuts penetrate into the hollow interior of the tubular material.

The directional slits may be positioned at substantially equal intervals along the conveyance track. Further, the directional slits may be substantially parallel to one another.

The device may be modular, with a plurality of generally straight conveyer sections and a plurality of curved conveyer sections. If modular, the device is assembled by selectively connecting the generally straight conveyer sections with the curved conveyer sections. A single air mover may provide air to each plenum or an air mover may be provided for each plenum.

BRIEF DESCRIPTION OF THE DRAWINGS

The invention will be readily understood by reference to the following description of preferred embodiments described by way of example only, with reference to the accompanying drawings in which like reference characters represent like elements, wherein.

DETAILED DESCRIPTION OF THE PREFERRED EMBODIMENTS

The present invention will now be described with reference to preferred embodiments and examples which are given by way of example only, not limitation.

Figure 1:
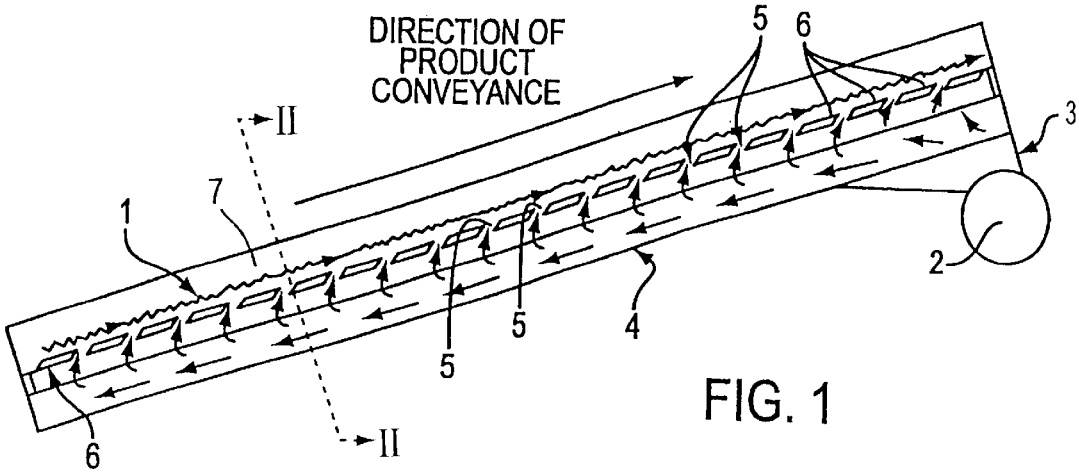
FIG. 1 is a side view of an air jet conveyor according to a first preferred embodiment of the present invention.

FIG. 1 is a side view of an air jet conveyor according to a first preferred embodiment of the present invention. FIG. 1 shows crimped material (perhaps crimped fibers) 1 being conveyed from the lower left of the figure to the upper right of the figure. Air is supplied from a blower 2. Blower 2 may provide low pressure, high volume air flow. Although pressurized air flow can be provided, the requirements of a compressor and an air tight plenum will increase costs. From blower 2, air is transported through a transition duct 3. The transition duct 3 is attached to an air plenum 4 so that the air travels from the blower 2 through the transition duct 3 then through the air plenum 4. In FIG. 1, the direction of product conveyance is opposite to the direction of air flow through plenum 4.

From the air plenum 4, air exits the conveyor through a plurality of equally spaced narrow directional slits 5. Each directional slit 5 is formed between the leading edge of a first air knife 6 and the lagging edge of a second air knife 6. Taken together, the air knives 6 form a conveyance track on which the crimped fiber 1 can travel. The directional slits 5 between the air knives force the air traveling from the blower to switch directions so that the air flows from the air knives into the conveyance track at an angle. The angled air flow provides lift and thrust to the crimped fiber 1. Although the device shown in FIG. 1 has air flowing through the air plenum 4 in a direction opposite to the direction of conveyance, the opposite direction is not necessary. The air could travel through plenum 4 the same direction as conveyance. To accomplish this, the blower 2 could be positioned at the lower left of FIG. 1, rather than the upper right of FIG. 1. Further, two blowers 2 could be provided, one positioned at each end of air plenum 4. A blower 2 could also be positioned in the middle of the air plenum 4, with or without one or more additional blowers. Although the exact blower 2—air plenum 4 configuration may not be important, what is important is that the air flow be maintained throughout the entire air plenum 4.

In FIG. 1, reference numeral 7 represents a side wall. Side wall 7 prevents the crimped material from falling off of the conveyance track as it travels. Although not shown in FIG. 1, there are two side walls 7, one on each side of the conveyance track. That is, FIG. 1 shows the air jet conveyor with one of the side wall 7 removed. The side walls 7 should be sufficiently high to hold the crimped fiber 1 on the conveyance track. If the conveyance track is sloped at a steep angle, higher walls 7 should be provided.

Figure 2:
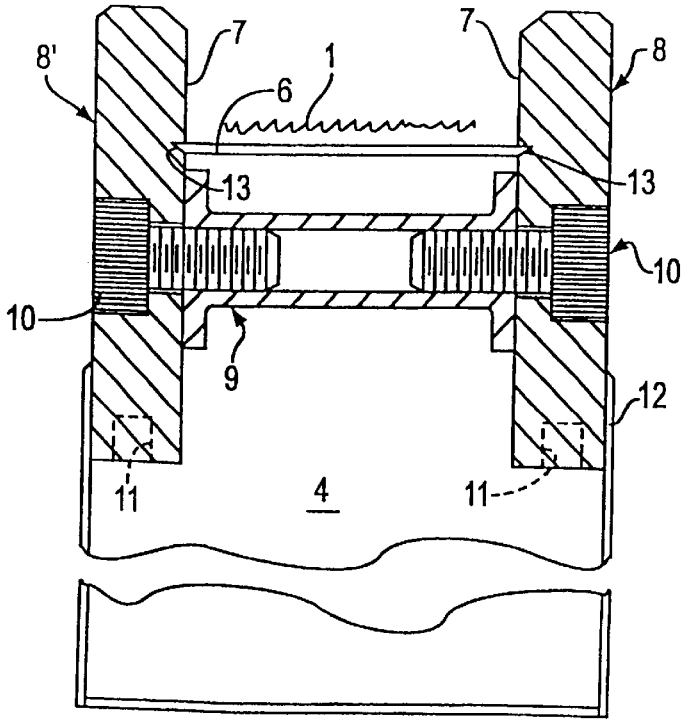
FIG. 2 is a cross-sectional end view of the air jet conveyor, taken through line II—II in FIG. 1.

FIG. 2 is a cross-sectional end view of the air jet conveyor, taken through line II—II in FIG. 1. As can be seen, the air jet conveyor is formed from two elongated support pieces 8, one on either side of the conveyance track. The air knives 6 fit within cut-out portions 13 provided in the support pieces 8. The cut-out portions 13 allow for the air knives 6 to be adjusted with different gaps there between. The gap between air knives 6 may be constant throughout the conveyor or may be varied to suit specific conveyance needs at different portions of the conveyance track. An O-ring seal may be provided within the cut-out portions 13, between the air knife 6 and the support pieces 8.

Above the air knives 6, the sides of the support pieces 8 form the side walls 7. Below the air knives 6, the sides of the support pieces 7 form the air plenum 4. A plurality of spacers 9 separate the two elongated supported pieces 8. The spacers 9 are attached to the support pieces 8 through bolts 10. The spacers 9 and bolts 10 are positioned throughout the length of the air jet conveyor, separated by a distance sufficiently long so as not to disturb air flow, but sufficiently short so as to provide good support.

The bottoms of elongated support pieces 8 may be provided with threaded holes 11, which are shown with phantom lines in FIG. 2. If provided, these threaded holes 11 receive bolts to attach a metal plate to the bottom of the elongated support pieces 8. This metal plate (if provided) defines the bottom of the air plenum 4, with the top of the air plenum 4 being defined by the air knives 6. FIG. 2 does not show the metal plate. Instead, conduit 12 is attached to the support pieces 8 to form the bottom of air plenum 4. Conduit 12 may be formed of a variety of materials, including plastic, aluminum and cardboard.

Figure 3:
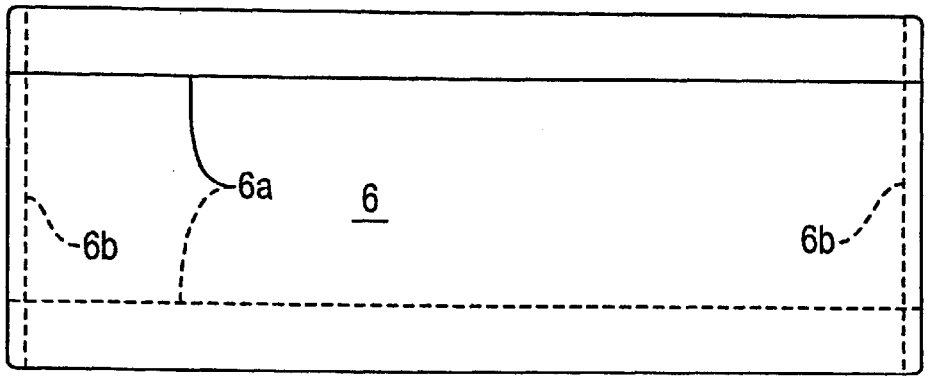
FIG. 3 is a top view of an air knife used in the air jet conveyor shown in FIG. 1.
Figure 4:
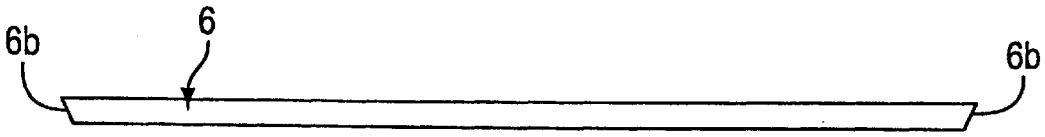
FIG. 4 is a side view of the air knife shown in FIG. 3.

FIG. 3 is a top view of the air knife 6 shown in FIGS. 1 and 2, and FIG. 4 is a side view of the air knife 6 shown in FIG. 3. All four sides of the air knife 6 are sloped. In FIG. 3, the horizontal lines **6*a* represent edges of the surfaces forming the directional slits, which slits can be seen in FIG. 1. The lower horizontal line 6*a* shows the edge where the angled portion meets the bottom surface of the air knife 6. The vertical lines 6*b* shown in FIG. 3 can better be seen in FIG. 4. These lines, shown in phantom in FIG. 3, represent the surfaces where the air knife 6 angles in from the top surface to meet the bottom surface. As can be seen in FIG. 2, the cut-out portions 13 in elongated support pieces 8 accommodate the air knives 6. The shape of the cut-out portions 13 corresponds with the shape of the side angles defined by lines 6*b* shown in FIGS. 3 and 4**.

Figure 5:
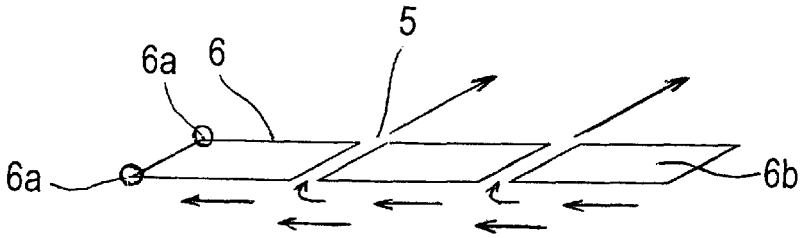
FIG. 5 is a side view of a plurality of the air knives shown in FIGS. 3 and 4.

FIG. 5 is a side view of a plurality of the air knives 6 shown in FIGS. 3 and 4. That is, the surfaces defined by lines **6*b* can be seen in FIG. 5. The arrows shown in FIG. 5 demonstrate how the air knives direct air flow. Specifically, air flows to the left through a plenum, and then is directed to upwardly and to the right at an angle. The angle is defined by the directional slits 5**.

The dimensions for the air knives 6 are variable. However, if the width of the directional slits 5 (the distance between adjacent air knives 6) is increased significantly, the thickness of the air knives 6 should also be increased. Otherwise, the air knives 6 may not be able to direct air to the desired angle. Similarly, the angle between the slits 5 (determined by the air knives—see lines **6*a***) and the conveyance track is variable as long as sufficient lift and thrust are provided.

In operation, the air streams produced by the directional slits 5 convey the crimped fiber such that only very small pulling forces are required at the end of the fiber. The crimps in the fiber catch the air jets emitted through the directional slits 5. This is true regardless of the direction of the crimp. That is, the fiber could be crimped in an up-and-down direction, normal to the plane of the fiber ribbon, or the fiber could be crimped in a back-and-forth direction, within the plane of the fiber ribbon. Either way, the crimp assists in catching the air jets and moving the fiber.

Figure 6:
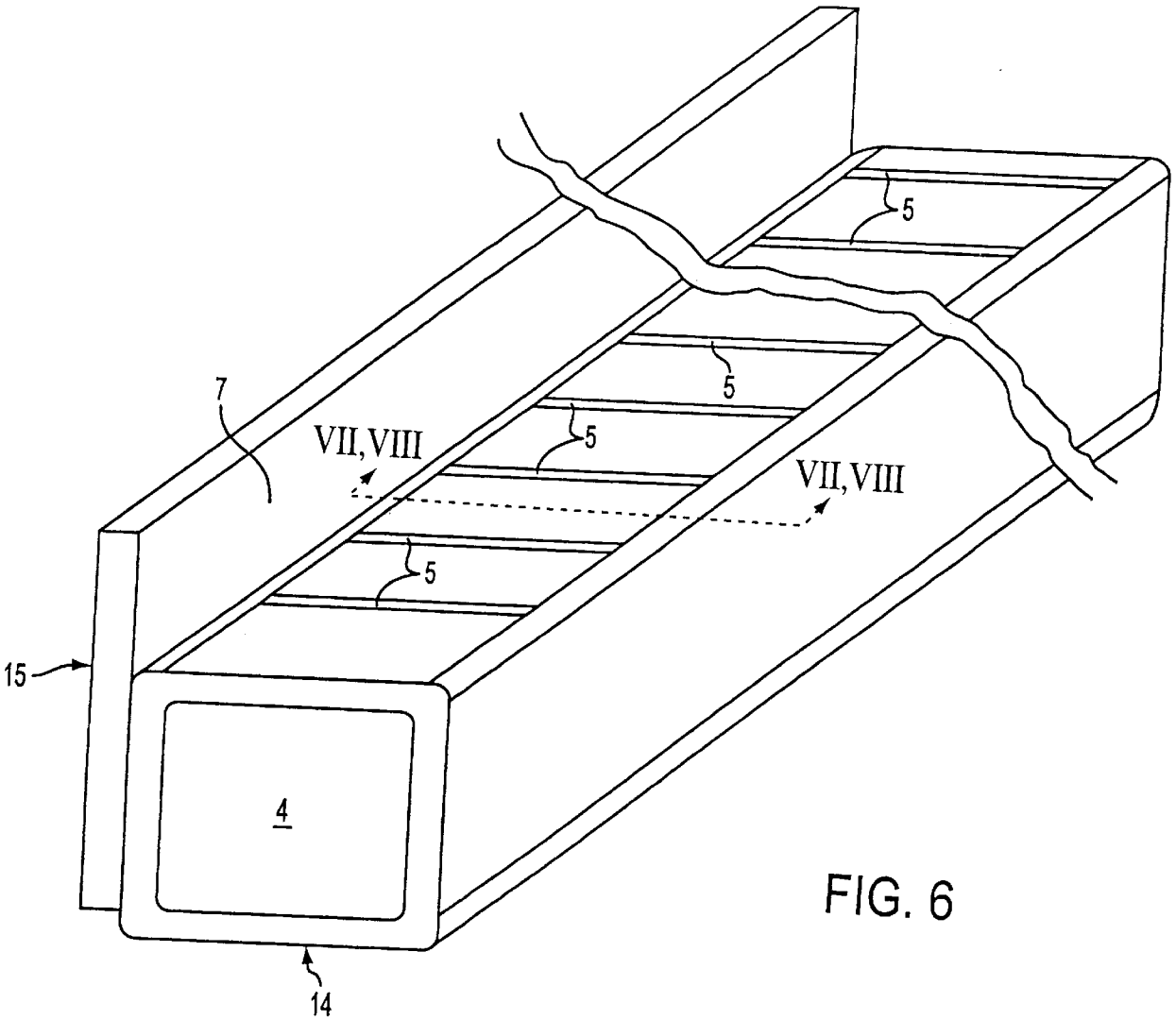
FIG. 6 is a perspective view of an air jet conveyor according to a second preferred embodiment of the present invention.

FIG. 6 is a perspective view of an air jet conveyor according to a second preferred embodiment of the present invention. Only those portions of the second preferred embodiment that differ from the first preferred embodiment will be described. In FIG. 6, a tubular channel 14 is used to formed the conveyance track. The tubular channel 14 may be formed of a variety of materials, including metals, such as aluminum, and plastics, such as PVC. The interior of the tubular channel 14 serves as the air plenum 4. Directional slits 5 are cut into the tubular channel 14 to direct air from the air plenum 4 to the conveyance track. A side sheet 15 is attached to either side of the tubular channel 14. The material for the side sheet is also variable. The side sheet may be attached by screws, an adhesive or other conventional means. FIG. 6 shows the second preferred embodiment with only one side sheet 15 attached to the tubular channel 14. The second side sheet, which would run parallel to the side sheet shown, has been removed. The upper portion of side sheets 15 formed the side walls 7.

Figure 7:
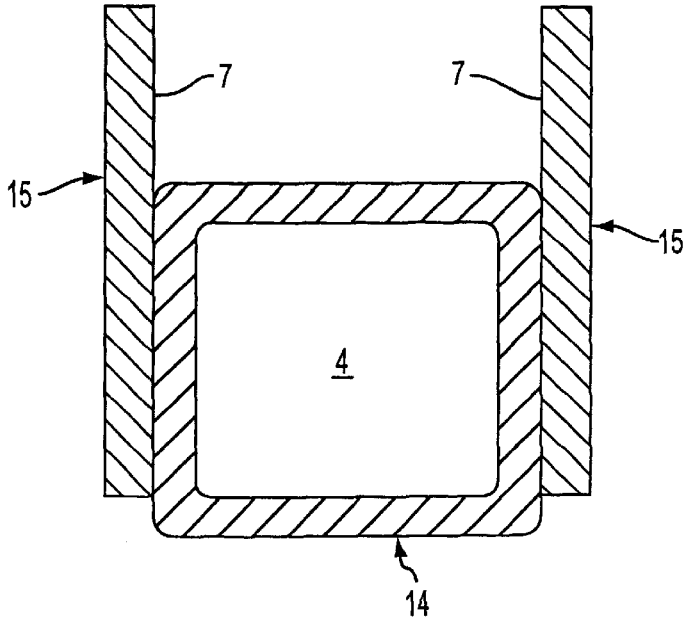
FIG. 7 is a cross-sectional end view of the air jet conveyor, taken through line VII, VIII—VII, VIII in FIG. 6.
Figure 8:
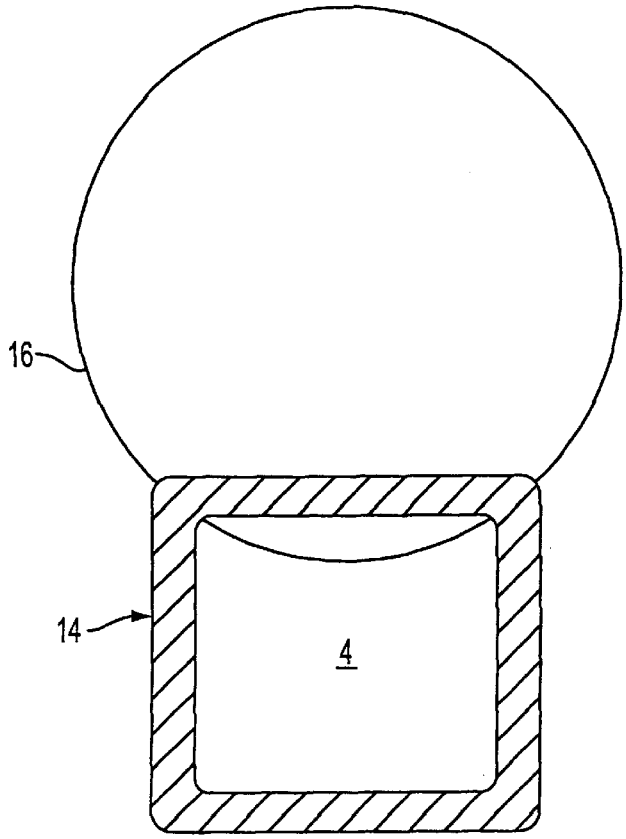
FIG. 8 is a cross-sectional view of a tubular channel, taken through line VII, VIII—VII, VIII in FIG. 6.

FIG. 7 shows an end cross-sectional view of the air jet conveyor, taken through line VII, VIII—VII, VIII in FIG. 6. FIG. 8 is a cross-sectional view of the tubular channel 14, taken through line VII, VIII—VII, VIII in FIG. 6, illustrating the cutting of the angular slits 5. In the first preferred embodiment, the directional slits were formed by air knives. In the second preferred embodiment, the directional slits are formed by cutting partially through the tubular channel 14 with a blade 16. The cuts are made at the desired angle, and FIG. 8 illustrates the depth of the cut. The cuts must be made sufficiently deep into the tubular channel 14 so as to open the directional slits to the air plenum 4. However, the cuts must be shallow enough so as to prevent air from exiting the sides of the tubular channel 14. To accomplish this, the diameter of the blade 16 used for cutting cannot greatly exceed the width of the tubular channel 14.

The air jet conveyor may turn to the left, to the right, up or down. For both the first and second preferred embodiments, it is important that all turns in the conveyance track be made gradually without abrupt changes. To accomplish this, bends can be formed in the conveyance track. For example, the elongated supported pieces 8 of the first embodiment or tubular channel 14 of the second embodiment can be formed with bend 5. Alternatively, a modular design is possible. Sections of the conveyance track can be prefabricated. To move the crimped material through a plant, generally straight track sections can be combined with track sections curving to the left, to the right, up and down. To make the invention even more adaptable, different length straight section and different angled curve sections can be produced. This modular approach allows for the invention to be adapted to existing equipment and reduces the cost to do so.

While the invention has been described in connection with the preferred embodiments and examples, it will be understood that modifications within the principles outlined above will be evident to those skilled in the art. For example, there are numerous ways to form directional slits other than air knives or cutting. Thus, the invention is not limited to the preferred embodiments and examples, but is intended to encompass such modifications.

What is claimed is:

1. A device for conveying a planar ribbon of crimped material, comprising:

an air mover;

a plenum connected to the air mover to receive air from the air mover;

a series of substantially planar air knives arranged adjacent to one another to form directional slits between the air knives, the directional slits being in fluid communication with the plenum so that air from the plenum exits through the directional slits in a predetermined direction, the directional slits being arranged in a generally planar configuration to form a conveyance track; and sides walls provided on either side of the conveyance track and extending above the conveyance track, the side walls each having a slot formed therein, the air knives having ends fitting within the slots in the side walls.

2. A device for conveying a planar ribbon of crimped material according to claim 1, wherein the crimped material is a planar band of crimped fiber.

3. A device for conveying a planar ribbon of crimped material according to claim 1, wherein the crimped material is a planar band of crimped acetate fiber.

4. A device for conveying a planar ribbon of crimped material according to claim 1, wherein the crimped material has crimps that extend in an up-and-down direction, normal to a plane of the crimped material.

5. A device for conveying a planar ribbon of crimped material according to claim 1, wherein the air knives are at positions within the slots, which are adjustable so that the spacing between the air knives can be varied.

6. A device for conveying a planar ribbon of crimped material according to claim 1, wherein the directional slits are positioned at substantially equal intervals along the conveyance track.

7. A device for conveying a planar ribbon of crimped material according to claim 1, wherein the directional slits are substantially parallel to one another.

8. A device for conveying a planar ribbon of crimped material according to claim 1, wherein the air mover is a fan or blower connected to the plenum.

9. A method of pneumatically conveying a ribbon of fibrous crimped material, comprising the steps of:

moving air into a plenum;

providing a series of directional slits in fluid communication with the plenum, the directional slits being arranged in a generally planar configuration to form a conveyance track;

providing sides walls on either side of the conveyance track such that the side walls extend above the conveyance track; and conveying the ribbon of fibrous crimped material along the conveyance track by producing air jets from the directional slits.

10. A method according to claim 9, wherein the ribbon of fibrous crimped material is a planar band of material.

11. A method according to claim 9, wherein the air jets are produced at substantially equal intervals along the conveyance track.

12. A method according to claim 9, wherein the air jets are substantially parallel to one another.

13. A method of pneumatically conveying a ribbon of crimped material comprising:

moving air into a plenum;

providing a series of directional slits in fluid communication with the plenum, the directional slits being arranged in a generally planar configuration to form a conveyance track;

providing sides walls on either side of the conveyance track such that the side walls extend above the conveyance track; and conveying the crimped material along the conveyance track by producing air jets from the directional slits, wherein the plenum includes a pair of elongated support pieces with cutout portions provided in the elongated support pieces, the directional slits are formed between air knives fitting into the cutout portions of the elongated support pieces, and the method further comprises the step of moving the air knives within the cutout portions to change the width of the slits formed between the air knives.

* * * * *

UNITED STATES PATENT AND TRADEMARK OFFICE

CERTIFICATE OF CORRECTION

PATENT NO. : 6,402,436 B1
DATED : June 11, 2002
INVENTOR(S) : David H. Murphy

It is certified that error appears in the above-identified patent and that said Letters Patent is hereby corrected as shown below:

Title page,
Item [56], References Cited, U.S. PATENT DOCUMENTS,
Delete "5,043,735 A 8/1991 Mawhinney et al.";
Delete "5,245,348 A 9/1993 Nishikawa et al."; and
Delete "5,537,122 A 7/1996 Eguchi".

FOREIGN PATENT DOCUMENTS,
Delete "DE 2 040 018 2/1972".

OTHER PUBLICATIONS,
Delete "Mitsumoto H. Et Al: "A Mobile Stellite News Gathering System Using A Flat Antenna" IEEE Transactions on Broadcasting, US, IEEE Inc. York vol. 42, No. 3 Sep. 1996, pp. 272-276.".

Signed and Sealed this

Twelfth Day of November, 2002

*Attest:*

*Attesting Officer*

JAMES E. ROGAN
*Director of the United States Patent and Trademark Office*